US005718627A

United States Patent [19]

Wicks

[11] Patent Number: 5,718,627

[45] Date of Patent: Feb. 17, 1998

[54] SYSTEM AND METHOD FOR SMOKE FREE ELEVATOR SHAFT

[76] Inventor: Edward A. Wicks, 11 W. Redding Rd., Danbury, Conn. 06810

[21] Appl. No.: 794,303

[22] Filed: Feb. 3, 1997

[51] Int. Cl.[6] ..... F24F 11/00

[52] U.S. Cl. ..... 454/68; 454/251

[58] Field of Search ..... 454/68, 239, 251, 454/256, 257, 338

[56] References Cited

U.S. PATENT DOCUMENTS

| | | | |
|---|---|---|---|
| 5,215,499 | 6/1993 | Eberhardt | 454/338 X |
| 5,462,485 | 10/1995 | Kindead | 454/256 |

FOREIGN PATENT DOCUMENTS

| | | | |
|---|---|---|---|
| 59-170633 | 9/1984 | Japan | 454/68 |
| 62-190340 | 8/1987 | Japan | 454/257 |

*Primary Examiner*—Harold Joyce
*Attorney, Agent, or Firm*—Robert J. Harter

[57] ABSTRACT

A system and method for maintaining elevator use during a fire includes a blower and a damper at opposite ends of an elevator shaft to create a full volume current of fresh air that engulfs a conventional elevator car traveling between floors. The unidirectional airflow provides a curtain of air that "washes" any smoke away from the exterior of the elevator car. When the car stops at a floor, the damper closes to force the fresh airflow onto that floor. Fresh air is chosen from one of several fresh air supplies by sensing the quality of the air at the supplies.

11 Claims, 4 Drawing Sheets

42
26
24
14
48
62
12
18
14
56

SYSTEM AND METHOD FOR SMOKE FREE ELEVATOR SHAFT

BACKGROUND OF THE INVENTION

1. Field of the Invention

The subject invention generally pertains to elevators, and more specifically to a system and method of safely using an elevator for evacuation during a fire.

2. Description of Related Art

There are several known systems that pertain to elevator use during a fire. U.S. Pat. No. 4,592,270 discloses a novel air duct coupled to deliver air directly to an elevator car. When the elevator doors are closed, the air supply appears to have no place to escape except by leakage past the doors. The '270 system requires an add-on duct installed inside the elevator shaft. The system does not disclose a roof discharge vent, the system does not provide a full volume of unidirectional fresh airflow through the elevator shaft, and the system requires modifying a conventional elevator car with a sliding type air coupling. If the elevator car were to stall between floors during a fire, the mount of fresh airflow to the elevator shaft would be very limited due to the very limited discharge leaving the elevator shaft. Likewise, the fresh air available to the car itself may be even less.

U.S. Pat. No. 5,033,360 discloses an elevator shaft that appears to be vented to blow air across every floor of the building. Such a system could not maintain a constant volume flow rate along the length of the elevator shaft.

U.S. Pat. No. 4,944,216 shows how an elevator shaft serves as a convenient location for an exhaust duct used to draw smoke away from a fire.

U.S. Pat. No. 3,817,161 discloses an elevator car that locks onto a floor filled with smoke. Air is supplied to the elevator shaft by way of a blower at the lower end of the shaft or, as an alternative, by way of a vent at the upper end of the shaft (see FIG. 2). A car mounted blower (item 21) draws the air into the car and discharges it out onto the smoke-filled hallway.

None of the existing systems senses the air quality of a plurality of air supplies and then selects the one best able to provide truly fresh air. None generates a constant volume, unidirectional curtain of airflow that passes across the full length of an elevator shaft. And none provides an exhaust damper that opens to allow a generous volume of fresh airflow through the elevator shaft when the car is between floors, and closes when the car stops at a floor to force a significant portion of the airflow onto the floor.

SUMMARY OF THE INVENTION

To avoid the limitations and problems of existing elevator systems, it is one object of the invention to provide a full volume, steady current of fresh air that engulfs an elevator car when it is between floors.

A second object is to redirect that full volume current of air onto a floor at which the elevator car stops.

A third object is to provide selection of fresh air supplies and provide an air quality sensor to determine which supply to choose.

A fourth object is to establish an air curtain effect that "washes" smoke away from the exterior of an elevator car.

A fifth object is to provide an exhaust damper that opens when the elevator car is between floors, and closes automatically when the car stops at a floor.

A sixth object is to provide a fire responsive elevator system that requires no modification to a conventional elevator car.

A seventh object is to keep an elevator in continued operation during a fire to facilitate evacuation of any non-ambulatory occupants of the building. A backup power supply is provided when necessary.

An eighth object is to maintain an elevator shaft at a higher air pressure than the rest of the building to inhibit smoke from entering the elevator shaft.

These and other objects of the invention are provided by a novel system and method for elevator use during a fire. The invention involves selecting one of several flesh air supplies by sensing the quality of the air at the supplies. A blower and a damper at opposite ends of an elevator shaft create a full volume current of air that engulfs an elevator car traveling between floors. When the car stops at a floor, the damper closes to force the fresh airflow onto that floor.

DESCRIPTION OF THE PREFERRED EMBODIMENT

Figure 1:
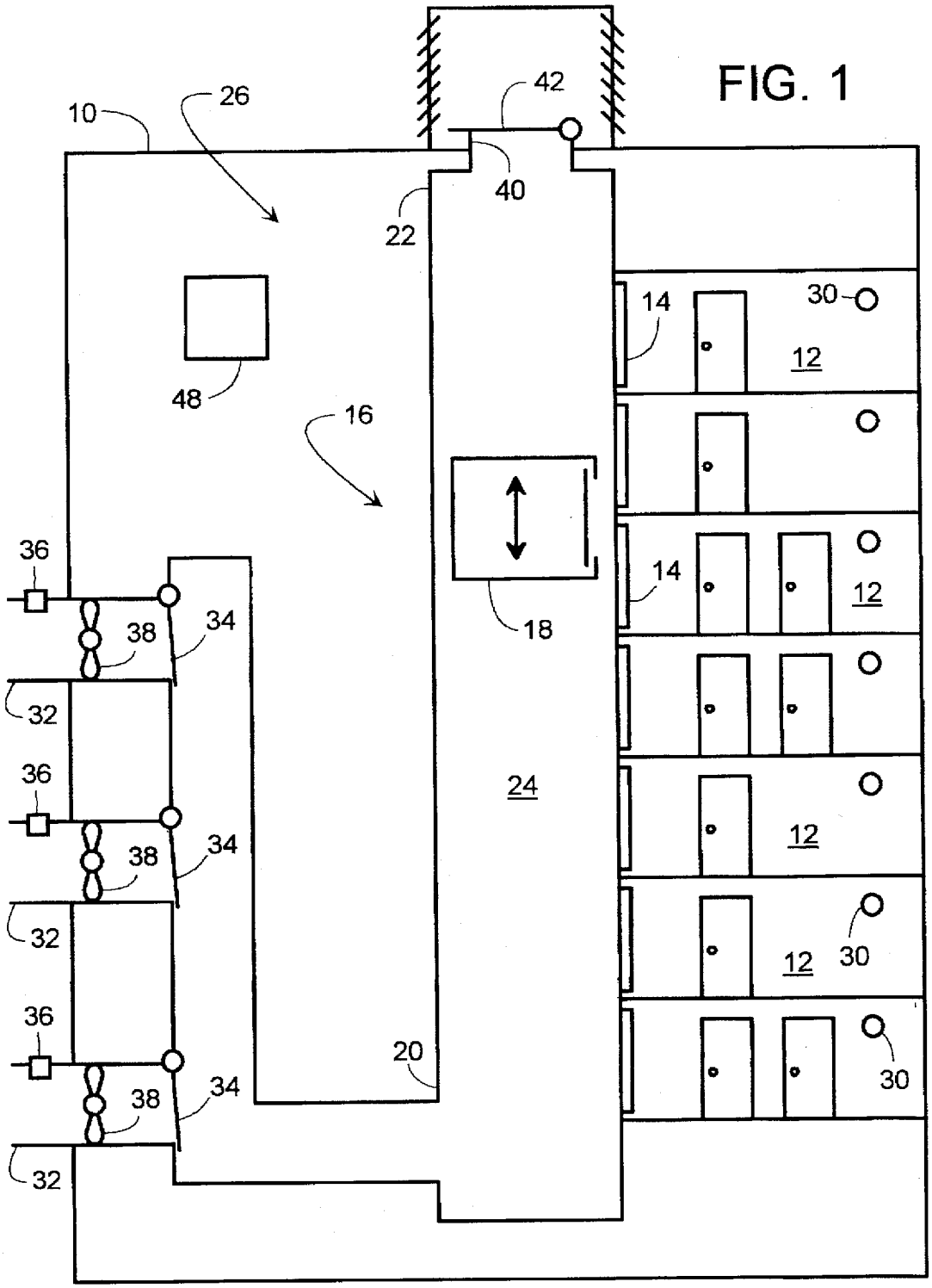
FIG. 1 is a schematic view of the invention in the absence of a fire.
Figure 2:
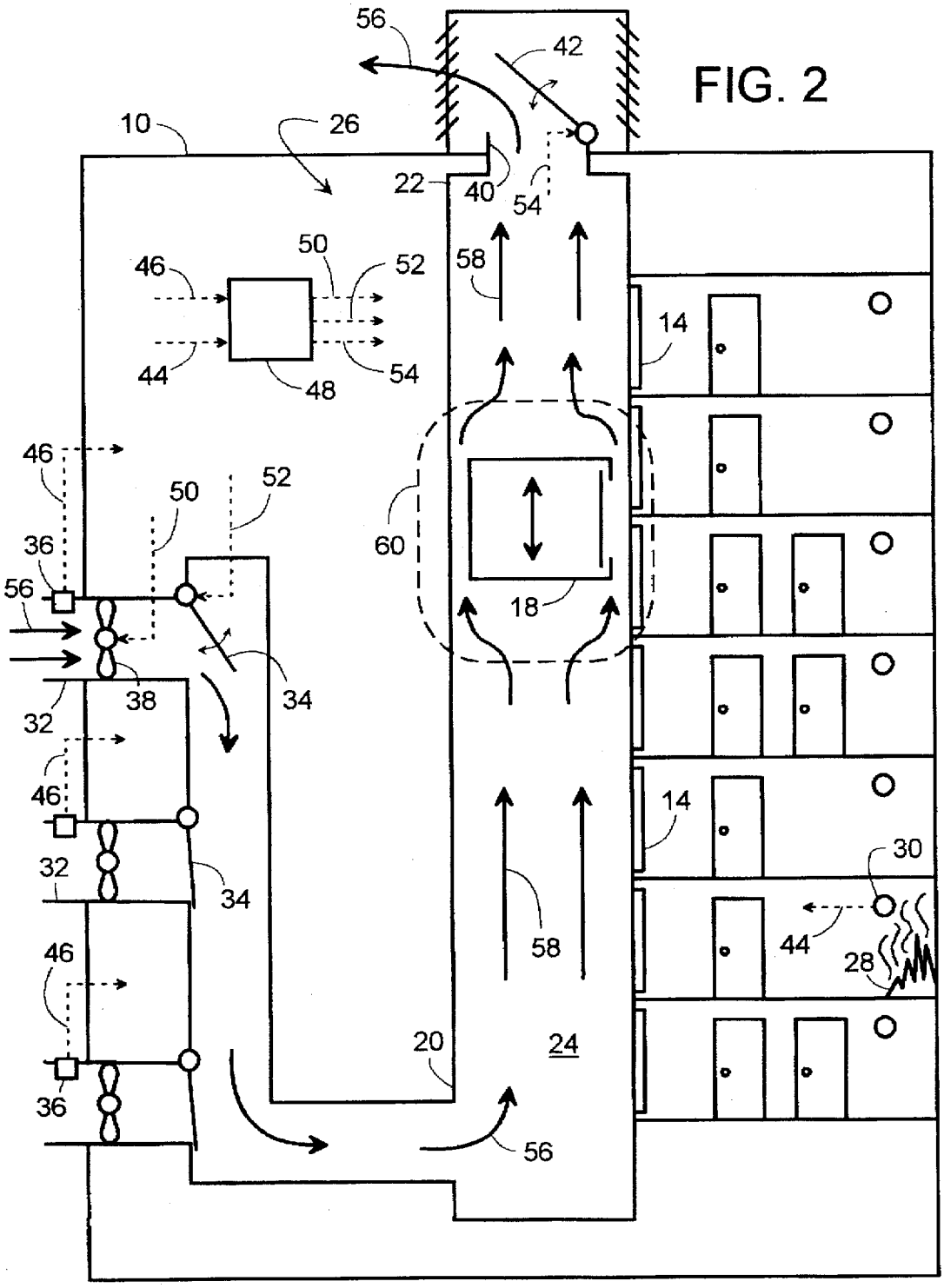
FIG. 2 is a schematic view of the invention reacting to a fire with the elevator car traveling between floors.

FIG. 1 shows a building 10 having various floors 12 each having a door 14 that allows people to enter and exit a conventional elevator car 18 that travels between one end 20 and an opposite end 22 of an elevator shaft 24. Building 10 is equipped with an elevator system 26 that is responsive to a fire 28 (FIG. 2). Elevator system 26 includes at least one fire detector 30, multiple fresh air supplies 32 with supply dampers 34, air quality sensors 36 (e.g., smoke detector), a blower 38, and an exhaust vent 40 with an exhaust damper 42. In the absence of a fire, elevator 16 functions as any conventional elevator.

However, referring to FIG. 2, fire detector 30 generates an alarm signal 44 upon detecting a characteristic of fire such as smoke, heat, or ionized particles. Upon sensing an air quality feature of air supplies 32, air quality sensors 36 generate an air quality signal 46 that indicates the freshness of air supplies 32, i.e., its freedom from contaminants such as smoke and carbon monoxide. A control 48 monitors the operation of elevator 16 and receives alarm signal 44 along with air quality signal 46. In response to the inputs, control 48 provides output signals 50, 52 and 54 to control the operation of blowers 38, dampers 34 and damper 42, respectively. In the presence of fire 28, any dampers 34 and blowers 38 associated with a contaminated air supply 32 are shut down, while a damper 34 and blower 38 of a fresh air supply 32 is activated to deliver a supply of fresh air 56 to one end 20 of elevator shaft 24. In other words, dampers 34 selectively place at least one air supply 32 in fluid communication with elevator shaft 24 in response to alarm signal 44 and air quality signal 46. At opposite end 22 of shaft 24, damper 42 is open to create a generally unidirectional current of airflow 58 (with the exception of an airflow disturbance at a region 60 around car 18) of a substantially constant volume flow rate (excluding inconsequential leakage past closed doors 14) from end 20 to end 22. This current of air engulfs the exterior top, bottom, and sides of elevator car 18. When every door 14 is closed, substantially all of fresh air 56 discharges through vent 40.

Figure 3:
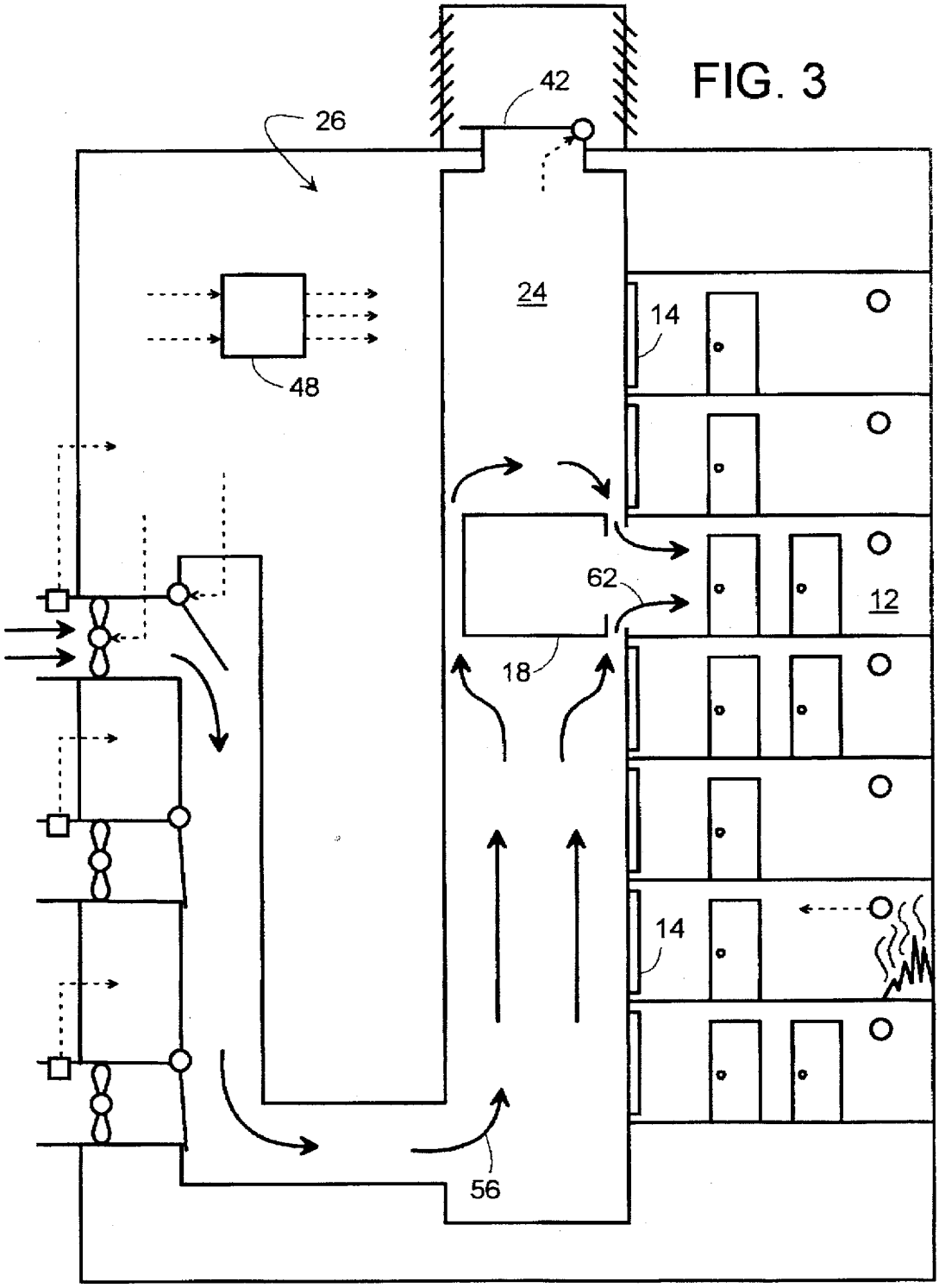
FIG. 3 is a schematic view of the invention reacting to a fire with the elevator car stopped at a floor.

Referring to FIG. 3, a first air pressure in shaft 24 is greater than a second air pressure at various floors 12. Therefore, when car 18 stops at a particular floor, the floor's corresponding door 14 opens, and at least a portion 62 of fresh air 56 rushes onto that floor 12. To maximize the airflow onto a floor 12, damper 42 closes. In one embodiment of the invention, control 48 commands damper 42 to close upon determining a door 14 is open. In another embodiment of the invention, damper 42 closes under its own weight due to a drop in the upstream air pressure caused by the opening of a door 14. Once every door 14 is closed, damper 42 re-opens to re-establish the current of flesh air through elevator shaft 24. This allows repeatedly opening and closing door 14 at any floor 12 on an ongoing basis as needed to allow people continued access to elevator car 18 from various floors 12, regardless of alarm signal 44.

Figure 4:
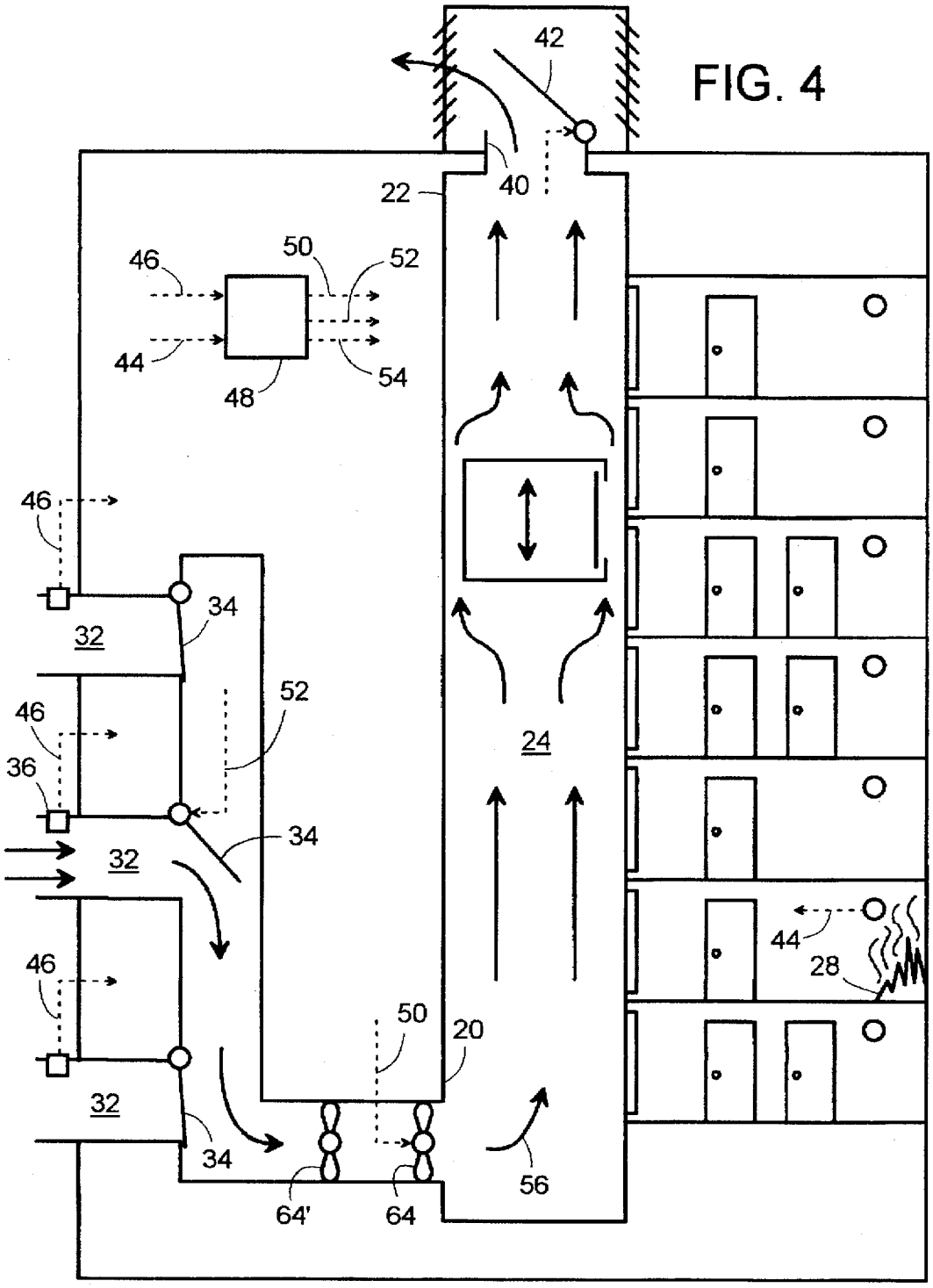
FIG. 4 is a schematic view of an alternate embodiment of the invention where the air supplies share a common blower.

In another embodiment of the invention, shown in FIG. 4, air supplies 32 share a common blower 64 with a redundant or backup blower 64'. FIG. 4 also shows a different air supply 32 chosen in response to air quality signal 46. In practice, the locations of air supplies 32 should be widely separated, such as on the north, south, east and west sides of the building, to ensure that there is at least one air supply 32 that isn't exposed to the smoke of fire 28. A system might get by with just one air quality sensor 36 located near end 20 of elevator shaft 24, and dampers 34 could be opened and closed on a trial and error basis until a noncontaminated fresh air supply is found.

It should be mentioned that the air inlet at end 20 and the outlet at end 22 can be reversed to place vent 40 and damper 42 at the bottom of elevator shaft 24 with the fresh air supplied at the top. In addition, control 48 is shown schematically at a single location; however, it would be obvious to those skilled in the art to separate control 48 into various components as desired. It should also be mentioned that the step of closing and opening a door is schematically depicted by respectively showing and deleting the door.

Although the invention is described with respect to a preferred embodiment, modifications thereto will be apparent to those skilled in the art. Therefore, the scope of the invention is to be determined by reference to the claims which follow.

I claim:

1. A method of responding to a fire in a building having various floors each having a door that allows people to enter and exit an elevator car that travels between one end and an opposite end of an elevator shaft with said one end being selectively coupled in fluid communication with a plurality of air supplies and with said opposite end having a vent, said method comprising the steps of:

detecting said fire;

generating an alarm signal in response to said step of detecting;

sensing an air quality feature of said plurality of air supplies;

generating an air quality signal in response to said step of sensing;

selectively placing at least one of said plurality of air supplies in fluid communication with said elevator shaft in response to said alarm signal and said air quality signal;

in response to said alarm signal, drawing fresh air from said at least one of said plurality of air supplies and discharging said fresh air into said one end of said elevator shaft at a first air pressure that is greater than a second air pressure of said various floors;

engulfing the exterior of said elevator car with said fresh air as said fresh air travels through said elevator shaft;

repeatedly opening and closing said door of any of said various floors on an ongoing basis as needed to allow said people continued access to said elevator car from said various floors, regardless of said alarm signal;

discharging at least a portion of said fresh air from said elevator shaft onto one of said various floors when said door at any of said various floors is open; and discharging substantially all of said fresh air out through said vent at said opposite end of said elevator shaft when each said door of said various floors is closed, thereby creating a generally unidirectional current of airflow of a substantially constant volume flow rate from said one end to said opposite end of said elevator shaft with the exception of said generally unidirectional current of airflow being disturbed at a region around said elevator car.

2. The method of claim 1 wherein said vent includes an exhaust damper, and said method further comprises the step of:

opening and closing said exhaust damper along with respective closing and opening of said door at any of said various floors.

3. The method of claim 1 wherein said step of coupling at least one of said plurality of air supplies to said elevator shaft is carried out by way of selectively and individually opening and closing a plurality of supply dampers associated with said plurality of air supplies.

4. The method of claim 1 wherein said plurality of air supplies are associated in one-to-one correspondence with a plurality of blowers each being turned on and off in response to said alarm signal and said air quality signal.

5. The method of claim 1 wherein said plurality of air supplies are associated with at least one blower, with the number of air supplies being greater than the number of blowers.

6. A method of responding to a fire in a building having various floors each having a door that allows people to enter and exit an elevator car that travels between one end and an opposite end of an elevator shaft with said one end being selectively coupled in fluid communication with a plurality of air supplies and with said opposite end having an exhaust damper, said method comprising the steps of:

detecting said fire;

generating an alarm signal in response to said step of detecting;

sensing an air quality feature of said plurality of air supplies;

generating an air quality signal in response to said step of sensing;

individually opening and closing a plurality of supply dampers associated in one-to-one correspondence with said plurality of air supplies to selectively place at least one of said plurality of air supplies in fluid communication with said elevator shaft in response to said alarm signal and said air quality signal;

in response to said alarm signal, drawing fresh air from said at least one of said plurality of air supplies and discharging said fresh air into said one end of said elevator shaft at a first air pressure that is greater than a second air pressure of said various floors;

engulfing the exterior of said elevator car with said fresh air as said fresh air travels through said elevator shaft;

repeatedly opening and closing said door of any of said various floors on an ongoing basis as needed to allow said people continued access to said elevator car from said various floors, regardless of said alarm signal;

discharging substantially all of said fresh air out through said exhaust damper at said opposite end of said elevator shaft when each said door of said various floors is closed, thereby creating a generally unidirectional current of airflow of a substantially constant volume flow rate from said one end to said opposite end of said elevator shaft with the exception of said generally unidirectional current of airflow being disturbed at a region around said elevator car; and closing said exhaust damper when said door at any of said various floors is open, thereby forcing said fresh air out through said door.

7. The method of claim 6 wherein said plurality of air supplies are associated in one-to-one correspondence with a plurality of blowers each being turned on and off in response to said alarm signal and said air quality signal.

8. The method of claim 6 wherein said plurality of air supplies are associated with at least one blower, with the number of air supplies being greater than the number of blowers.

9. An elevator system responsive to a fire in a building having various floors each having a door that allows people to enter and exit an elevator car that travels between one end and an opposite end of an elevator shaft, said elevator system comprising:

a fire sensor generating an alarm signal in response to sensing a characteristic of said fire;

a plurality of air supplies coupled to said one end of said elevator shaft;

an air quality sensor generating an air quality signal in response to a state of air quality of said plurality of air supplies;

a plurality of supply dampers associated in one-to-one correspondence with said plurality of air supplies, said plurality of supply dampers being activated by said alarm signal to individually open and close as a function of said air quality signal to ensure that a supply of fresh air is delivered from said plurality of air supplies to said one end of said elevator shaft;

a blower coupled to said plurality of air supplies and activated by said alarm signal to deliver said supply of fresh air to said elevator shaft at a first air pressure that is greater than a second air pressure of said various floors; and an exhaust damper coupled to said opposite end of said elevator, said exhaust damper closing in an absence of said alarm signal, said exhaust damper also closing upon said door opening at any of said various floors, when said alarm is present so that a portion of said supply of fresh air passes through said door that is open, and said exhaust damper opening in response to said alarm signal when each said door of said various floors is closed, thereby engulfing said elevator car with said supply of fresh air by creating a generally unidirectional current of fresh airflow of a substantially constant volume flow rate from said one end to said opposite end of said elevator shaft with the exception of said generally unidirectional current of fresh airflow being disturbed at a region around said elevator car.

10. The elevator system of claim 9 further comprising a plurality of blowers associated in one-to-one correspondence with said plurality of supply dampers, said plurality of blowers being turned on and off in response to said alarm signal and said air quality signal.

11. The elevator system of claim 9, further comprising a plurality of blowers associated with said plurality of air supplies, but with the number of air supplies being greater than the number of blowers.

* * * * *